United States Patent [19]

Fast

[11] Patent Number: 4,625,441

[45] Date of Patent: Dec. 2, 1986

[54] WAREHOUSE LABEL HOLDER ASSEMBLY

[76] Inventor: Jacob Fast, 7561 NW. 9th St., Plantation, Fla. 33317

[21] Appl. No.: 748,830

[22] Filed: Jun. 26, 1985

[51] Int. Cl.[4] ..... G09F 3/18

[52] U.S. Cl. ..... 40/10 R; 40/10 D

[58] Field of Search ..... 40/10 R, 10 D, 2 R, 40/617, 16; 229/DIG. 9

[56] References Cited

U.S. PATENT DOCUMENTS

| | | | |
|---|---|---|---|
| 1,537,788 | 5/1925 | Wentz | 40/617 |
| 3,327,416 | 6/1967 | Sanford | 40/10 R |
| 3,618,238 | 11/1971 | Willinger | 40/10 R |
| 4,509,277 | 4/1985 | Bolton | 40/10 D |
| 4,539,766 | 9/1985 | Fast | 40/10 R |

FOREIGN PATENT DOCUMENTS

| | | | |
|---|---|---|---|
| 1500221 | 9/1967 | France | 40/16 |
| WO83/03319 | 9/1983 | PCT Int'l Appl. . | |
| 858580 | 1/1961 | United Kingdom | 40/2 R |

*Primary Examiner*—Robert P. Swiatek
*Assistant Examiner*—Cary E. Stone
*Attorney, Agent, or Firm*—Holman & Stern

[57] ABSTRACT

A label holder assembly particularly for use in a bulk merchandise warehouse comprises a first label-holding pocket for adhering to a merchandise shelf to display a label with a regular product price, and a second label-holding pocket which can be releasably and selectively suspended from the first pocket to display, when required, another label with a promotional or sale price for the product.

7 Claims, 8 Drawing Figures

WAREHOUSE LABEL HOLDER ASSEMBLY

BACKGROUND OF THE INVENTION

This invention relates generally to labelling of merchandise and more particularly to label holders for use in warehouses providing bulk warehousing of products.

In bulk warehouses, merchandise is commonly stored on racks or shelves and labels displaying merchandise information may simply be adhered per se to the front of the shelf or, if label replacement is required, may be slid into transparent pockets which are themselves adhered or otherwise secured to the shelf. In either case, label replacement may be awkward, and in neither case is there a facility for displaying plural replacement labels for a particular product if, for example, a sale or promotional product price is to be displayed in conjunction with a regular price.

SUMMARY OF THE INVENTION

It is an object of the invention to provide improved label holding devices for particular use in warehouses where merchandise is displayed in bulk on shelves or racks.

A more particular object of the invention is to provide a label-holding device which offers a facility for displaying a single label which, if required, may be readily and expiditiously replaced, and which offers the further facility for additionally displaying plural labels, if so required, in a manner whereby the labels may readily be replaced individually.

Thus, in accordance with the present invention, a label holder assembly, particularly suitable for use in bulk warehouses and the like comprises a primary label-holding pocket formed of stiffish transparent sheet material, such as clear plastic, for adhesion directly to the front of a warehouse shelf, rack or the like, and for receipt of a first product label, and a secondary label-holding pocket of like material for selective suspension "piggy-back" fashion from the primary pocket, if required, for receipt of a second product label. It is understood that the primary label-holding pocket may be used on its own when only a single product label is required, the pocket design being such as to permit ready replacement of the single label, and if a second product label is required, for example in the event of a product sale or promotion when it is desireable to exhibit a comparison between a sale price and a regular price, the secondary pocket may readily be attached to and suspended from the primary pocket.

The primary label-holding pocket may, for example, comprise a rectangular card or blank folded to provide front and back panels, the front panel being extended beyond the free edge of the back panel to provide an upper edge portion having a contact adhesive on its rear surface, which prior to use may be covered with release paper. The pocket may be adhered to the front of a warehouse shelf, rack, or the like, and the configuration of the pocket is such that the back panel with its free upper edge is held against the outer surface of the shelf or rack to provide adequate retention of a label received in the pocket. Also, the free upper edge of the primary pocket provides a means allowing for simple attachment of the secondary pocket by hooking same over the free upper edge of the primary pocket from behind.

The secondary pocket may have an upper web portion which is somewhat wider than the primary pocket and which is provided with an elongate transverse slit for insertion therethrough of the back panel of the primary pocket (access thereto being obtained from behind the primary pocket) whereby the secondary pocket is suspended from the primary pocket. Below the web portion, the secondary pocket may be folded front and back panels similar to those of the primary pocket but in this case, the respective panels may have interengaging tabs and slits for attaching the top of the back panel to the front panel because, unlike the primary pocket where the back panel is supported against the shelf or rack, the bottom pocket may swing free below the shelf or rack so that securement of the back panel is desirable.

The respective pockets may be readily manufactured, for example by stamping and die cutting from readily available plastic sheet, and the assembly is simple to make up and use. Further, the design of the pockets allows for ready replacement of either the primary or secondary labels and simple attachment and detachment of the secondary pocket.

Additional features and advantages of the invention will be apparent from the ensuing description and claims read in conjunction with the accompanying drawings.

DESCRIPTION OF PREFERRED EMBODIMENT

Figure 1:
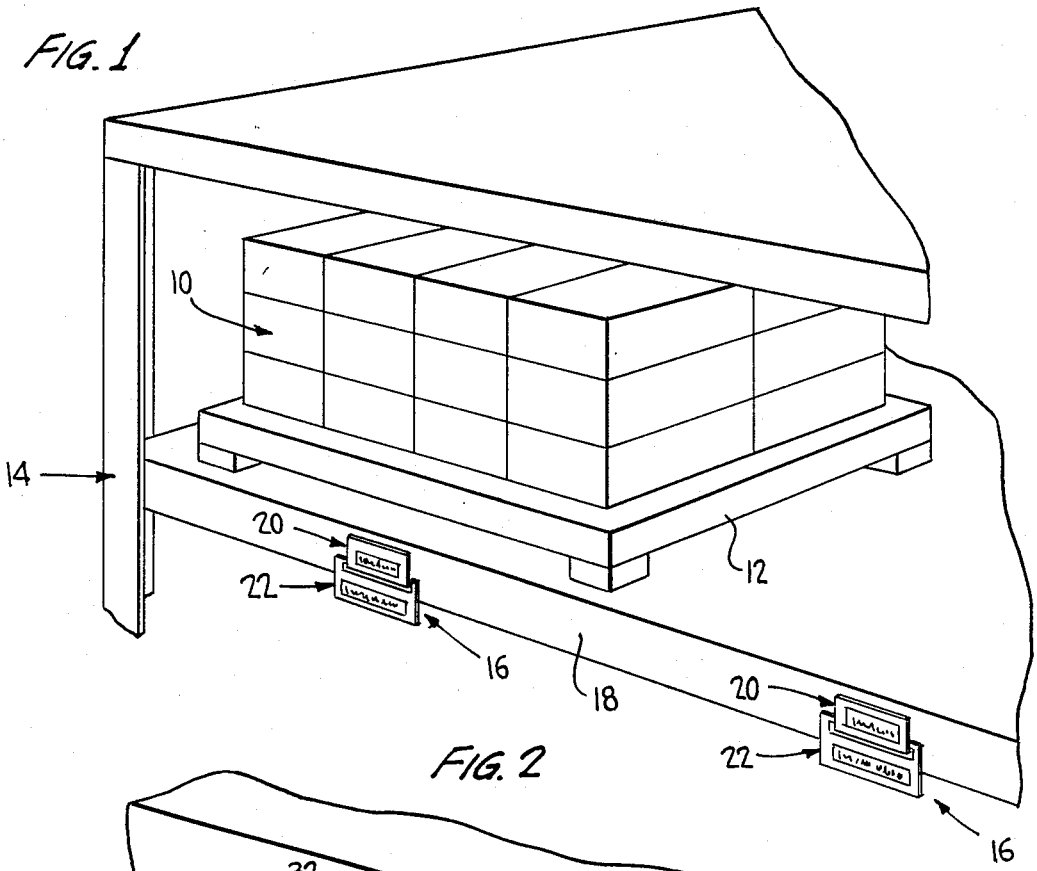
FIG. 1 is a perspective view of product label assemblies in accordance with the invention applied to a bulk warehouse shelf.
Figure 2:
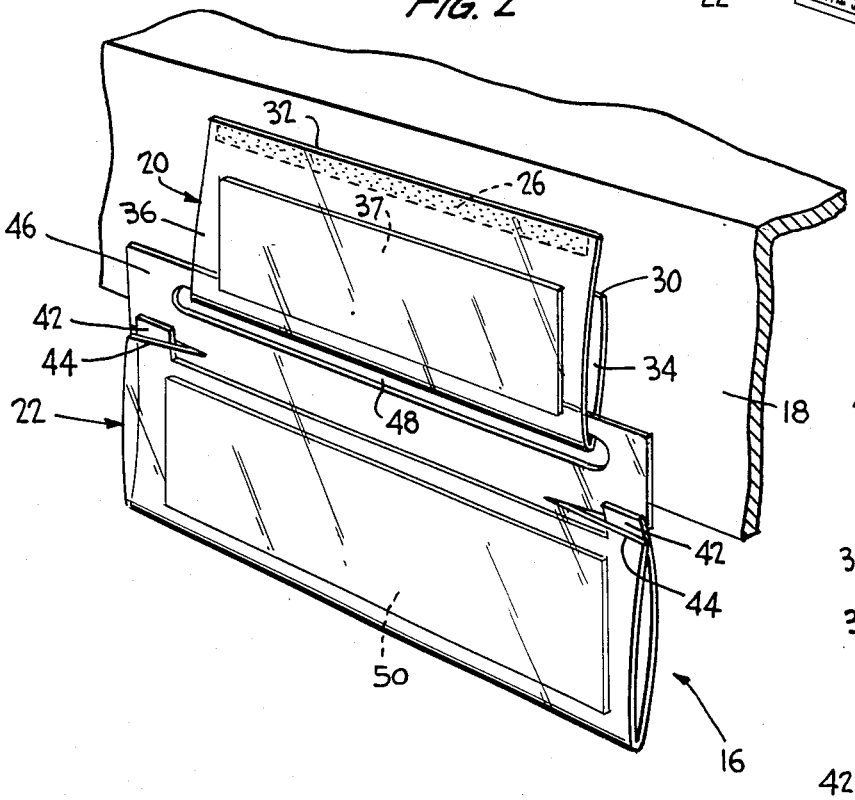
FIG. 2 is an enlarged perspective view of one of the assemblies and a part of the shelf.
Figure 3:
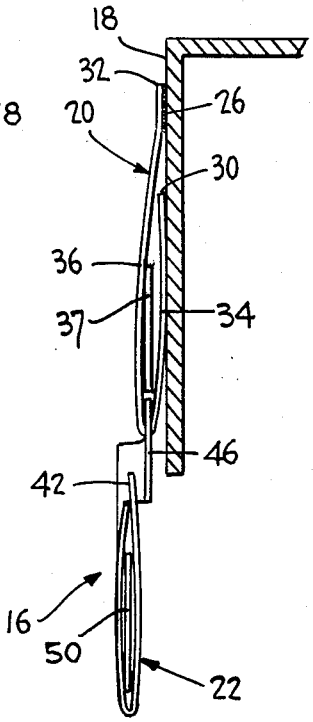
FIG. 3 is an end elevational view of the assembly and shelf portion.

In a bulk warehouse, merchandise 10 (FIG. 1) is commonly displayed on pallets, such as pallet 12, on shelving 14. In order to identify products and/or display product prices, the invention provides label assemblies 16 which may be adhered in a manner to be described to a front surface 18 of a product shelf. Each label assembly comprises a primary label-holding pocket 20 and a secondary label-holding pocket 22 which may be detachably suspended from the primary pocket, as required. The pockets may each be stamped or die cut from clear plastic sheet of a type well known for use in label holders.

Figure 4:
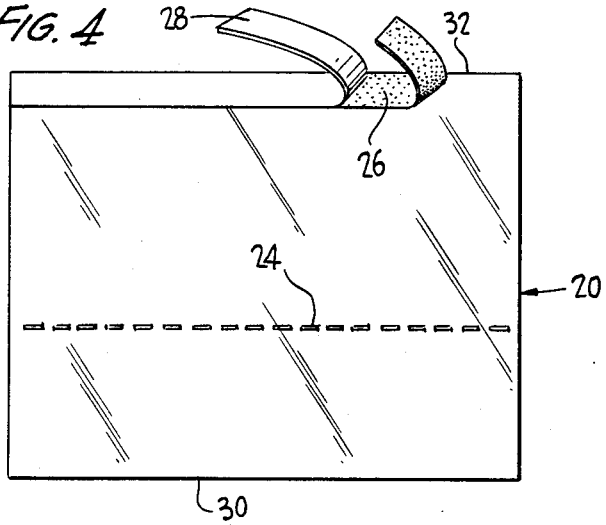
FIG. 4 is a view of a blank for forming a primary label-holding pocket of the assembly.
Figure 5:
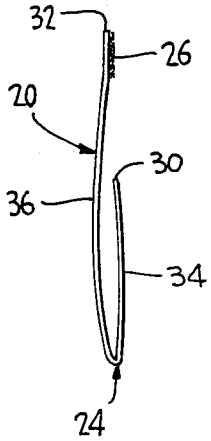
FIG. 5 is an end elevational view of the blank after folding to form the primary pocket.

Primary pocket 20 is formed from a rectangular blank (FIG. 4) having a transverse score or bend line 24 toward one edge 30, and a strip of pressure sensitive contact adhesive 26 covered by release paper 28 disposed along the opposite edge 32. To form the pocket, edge 30 is folded up along the bend line toward edge 32. The bend line is closer to edge 30 than to edge 32 so that pocket 20 is formed with a back panel 34 which is shorter than front panel 36. When the pocket is adhered to the front surface 18 of a shelf, a label 37 can readily be inserted into and removed from the pocket by sliding same in and out laterally. Also, although edge 30 of the pocket is unattached to the front panel, the back panel 34 of the pocket is supported against the front surface of the shelf, so that the label is securely retained in the pocket, without the need for such attachment. The primary pocket 20 can be used per se in this manner, as required, to display single labels, or it can be used in conjunction with the secondary pocket 22, if required, to display a pair of labels.

Figure 6:
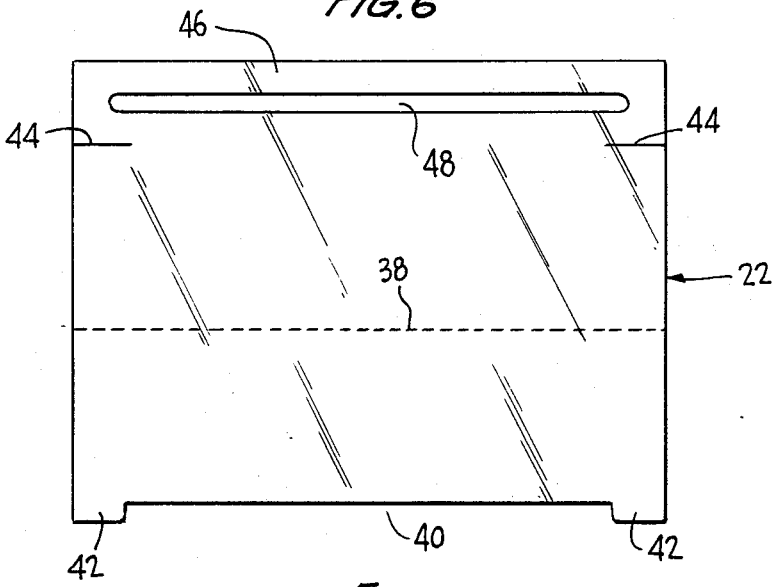
FIG. 6 is a view of a blank for forming a secondary label-holding pocket of the label assembly.
Figure 7:
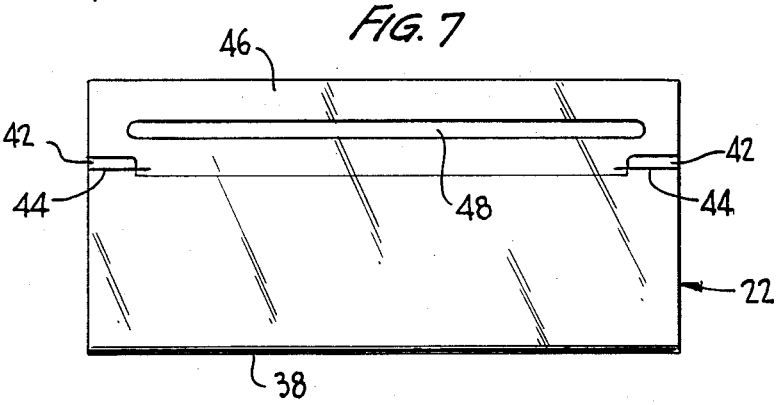
FIG. 7 is a view similar to FIG. 6 after folding the blank to form the secondary pocket.
Figure 8:
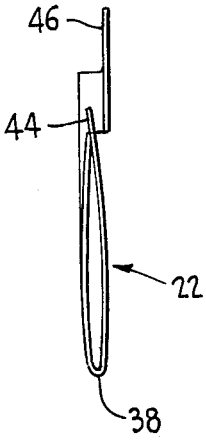
FIG. 8 is an end elevational view of the secondary pocket.

Secondary pocket 22 is formed from a rectangular blank (FIG. 6) which is wider than the primary pocket, the blank 22 having a transverse score or bend line 38, a cut-out 40 at its lower edge, defining tabs 42, slits 44 near its upper edge, spaced from the bend line a like distance to the tabs, and an upper web portion 46 with an elongate slot 48 which is somewhat longer than the width of primary pocket 20. The secondary pocket is formed by bending the blank along line 38 and inserting tabs 42 in slits 44. A label 50 can be inserted from either side or prior to assembly. The secondary pocket may be releaseably attached to the primary pocket, when required, by hooking slot 48 over the free back edge 30 of the primary pocket from behind. The attachment between the front and back panels of the secondary pocket by means of the tabs 42 and slits 44 is advisable for label retention because generally the second pocket will swing free below a shelf and, unlike the primary pocket, the back panel of the secondary pocket will not be supported by the front surface of the shelf.

It will be appreciated from the foregoing that the invention accordingly provides a particularly useful form of label holder, which can selectively be used to display single labels or plural labels as required, and wherein the labels may be readily replaced individually.

While only a preferred embodiment of the invention is being described herein detail, the invention is not limited thereby and modifications can be made within the scope of the attached claims.

I claim:

1. A label holder assembly comprising primary and secondary label-holding pockets each formed of sheet material such as clear plastic, the primary pocket comprising front and back panels connected along a lower edge of the pocket, and adhesive means on an upper edge portion of the front panel for securing the pocket to a front surface of a product shelf and the like with the back panel being supported against the surface, the back panel having a free upper edge located below the level of said upper edge portion of the front panel, the secondary pocket having front and back panels connected along a lower edge of the pocket and a web portion at the upper edge of the pocket with an elongate transverse slot for hooking over the free upper edge of the primary pocket from behind in order releasably and selectively to suspend the secondary pocket from the primary pocket.

2. The invention of claim 1 wherein the back panel of the secondary pocket terminates in tabs at the respective sides of the pocket for releasable receipt in corresponding transverse slits in the front panel for releasably securing the panels together.

3. The invention of claim 1 wherein the front and back panels of the respective pockets are integrally connected together and defined by transverse bend lines extending across the respective pockets defining the respective lower edges of the pockets.

4. A label holder assembly comprising primary and secondary label-holding pockets each formed of sheet material such as clear plastic, the primary pocket comprising front and back panels connected along a lower edge of the pocket , and adhesive means on an upper edge portion of the front panel for securing the pocket to a front surface of a product shelf and the like with the back panel being supported against the surface, the back panel having a free upper edge located below the level of said upper edge portion of the front panel, the secondary pocket having front and back panels connected along a lower edge of the pocket and a web portion at the upper edge of the pocket that is wider than the primary pocket, the web portion having attachment means for hooking onto the primary pocket in order releasably and selectively to suspend the secondary pocket from the lower edge of the primary pocket.

5. The invention of claim 4 wherein the attachment means comprises an elongate transverse slot in the web portion of the secondary pocket for hooking over the free upper edge of the primary pocket.

6. The invention of claim 5 wherein the back panel of the secondary pocket terminates in tabs at the respective sides of the pocket for releasable receipt in corresponding transverse slits in the web portion of the secondary pocket for hooking over the free upper edge of the primary pocket.

7. The invention of claim 5 wherein the front and back panels of the respective pockets are integrally connected together and defined by transverse bend lines extending across the respective pockets defining the respective lower edges of the pockets.

* * * * *